US007431643B2

(12) United States Patent
Dargue

(10) Patent No.: US 7,431,643 B2
(45) Date of Patent: Oct. 7, 2008

(54) CARD GAME WITH BLACKJACK AND POKER ASPECTS

(76) Inventor: Stan Dargue, 223 Lord Seaton Road, Toronto, Ontario (CA) M2P 1L2

( * ) Notice: Subject to any disclaimer, the term of this patent is extended or adjusted under 35 U.S.C. 154(b) by 32 days.

(21) Appl. No.: 11/218,751

(22) Filed: Sep. 2, 2005

(65) Prior Publication Data

US 2007/0052171 A1 Mar. 8, 2007

(51) Int. Cl.
*A63F 13/00* (2006.01)
*A63F 1/00* (2006.01)

(52) U.S. Cl. ..... 463/12; 273/293; 273/274; 463/13

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,494,295 | A | 2/1996 | Potter | |
| 5,496,038 | A | 3/1996 | Kangsanaraks | |
| 5,660,391 | A * | 8/1997 | Klasee | 273/292 |
| 5,660,392 | A | 8/1997 | Hansen | |
| 5,692,755 | A * | 12/1997 | Gutierrez | 273/292 |
| 5,732,950 | A | 3/1998 | Moody | |
| 6,102,402 | A | 8/2000 | Scott | |
| 6,322,075 | B1 * | 11/2001 | DeFranco | 273/274 |
| 6,406,023 | B1 * | 6/2002 | Rowe | 273/292 |
| 6,676,128 | B2 | 1/2004 | Wolf | |
| 6,733,012 | B2 | 5/2004 | Bio | |
| 6,776,416 | B1 | 8/2004 | Jackson | |
| 6,789,801 | B2 | 9/2004 | Snow | |
| 6,808,173 | B2 | 10/2004 | Snow | |
| 6,902,166 | B2 | 6/2005 | Stern | |
| 6,938,900 | B2 | 9/2005 | Snow | |
| 2003/0042679 | A1 | 3/2003 | Snow | |

OTHER PUBLICATIONS

Maverick Blackjack, Shuffle Master, World Gaming Congress and Expo, Oct. 14, 1997.*
(author unknown), Brag, www.pagat.com/vving/brag.html, printed Sep. 2, 2005 (but is prior art).
Shackleford, Michael, How to Play Blackjack, www.wizardofodds.com/blackjack, printed Sep. 2, 2005 (but is prior art).

* cited by examiner

*Primary Examiner*—Benjamin H Layno
(74) *Attorney, Agent, or Firm*—Muskin & Cusick LLC

(57) ABSTRACT

A card game that can be used for wagering purposes. A player can be dealt initial three cards and three two card hands can be formed from the initial cards. A three card hand can also be formed from the initial cards. The player can also have the option, after being dealt the initial cards, of choosing one out of the three cards to be replaced by a newly dealt card. The two card hands and the three card hand can then be paid according to a two card paytable and a three card paytable.

6 Claims, 5 Drawing Sheets

CARD GAME WITH BLACKJACK AND POKER ASPECTS

BACKGROUND OF THE INVENTION

1. Field of the Invention

The present invention is directed to a method, apparatus, and computer readable storage medium directed to a card game which can have elements of blackjack and poker.

2. Description of the Related Art

Casino games are currently a billion dollar industry. Casinos are always looking for new games to attract players to their casinos. Casinos are further interested in games which generate as much gaming action as possible, in order to increase profitability.

Blackjack is a popular wagering game involving two card (or more hands). Brag is another wagering game involving poker hands.

What is needed is a game that can combine elements of the popular games of blackjack and brag in a manner that can generate a lot of wagering action from players.

SUMMARY OF THE INVENTION

It is an aspect of the present invention to provide an enjoyable card game that can be used for wagering.

The above aspects can be obtained by a method that includes (a) receiving a first wager, a second wager, a third wager, and a fourth wager from a player; (b) dealing a first card, a second card, and a third card to the player; (c) paying the first wager based on a first two card hand formed between the first card and the second card; (d) paying the second wager based on a second two card hand formed between the second card and the third card; (e) paying the third wager based on a third two card hand formed between the first card and the third card; and (f) paying the fourth wager based on a three card hand formed between the first card, the second card, and the third card.

The above aspects can also be obtained by a method that includes (a) receiving a plurality of two card hand wagers from a player for each of a plurality of two card hands; (b) receiving a plurality of three card hand wagers from the player for each of a plurality of three card hands; (c) dealing a plurality of initial cards; (d) paying the plurality of two card hand wagers according to a first paytable, each two card hand wager based on a two card hand formed from the initial cards; and (e) paying the plurality of three card hand wagers according to a second paytable, each three card hand wager based on a three card hand from the initial cards.

The above aspects can also be obtained by an apparatus that includes (a) an input unit to receive a first wager, a second wager, a third wager, and a fourth wager from a player; (b) an output unit to display a first card, a second card, and a third card to the player; and (c) a paying unit to pay the first wager based on a first two card hand formed between the first card and the second card, to pay the second wager based on a second two card hand formed between the second card and the third card, to pay the third wager based on a third two card hand formed between the first card and the third card, to pay the fourth wager based on a three card hand formed between the first card, the second card, and the third card.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
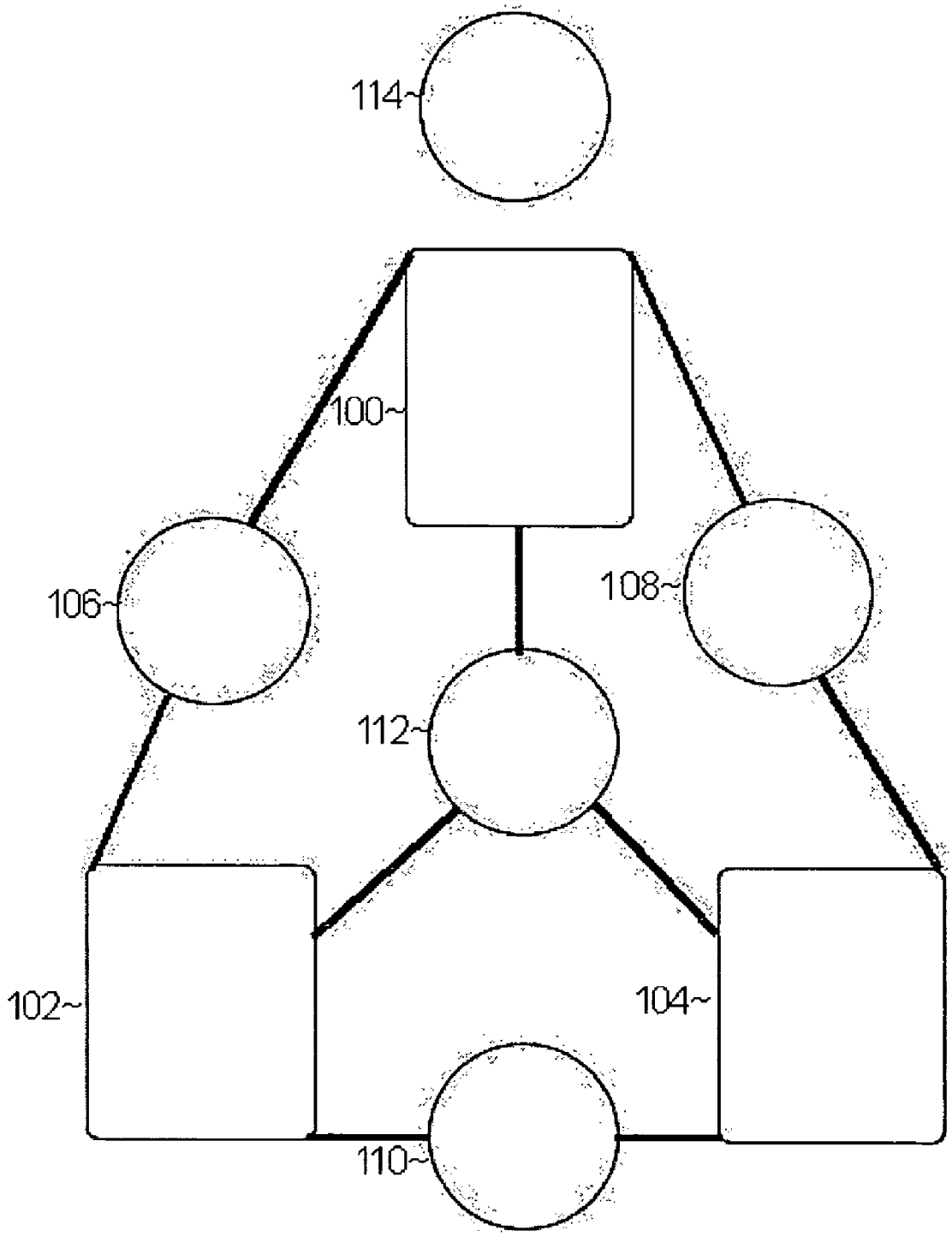
FIG. 1 illustrates an exemplary betting layout, according to an embodiment.

Reference will now be made in detail to the presently preferred embodiments of the invention, examples of which are illustrated in the accompanying drawings, wherein like reference numerals refer to like elements throughout.

The present general inventive concept relates to a method, apparatus, and computer readable storage medium, for a new card game based on blackjack and poker. At the start of each round, players are dealt three cards on a layout similar to the one below. The three cards are interconnected, forming a total of three two-card hands and one three-card hand. The object of the game is to make as many winning hands as possible through the use of a "switch card" an option that allows players to replace one of their original cards with a new card from the shoe. The two card hands are paid according to a two card hand paytable and the three card hands are paid according to a three card hand paytable.

The present game can be played with 4 standard 52 card decks with no jokers and follows standard blackjack and poker rules in determining the value of a hand. The game can also be played with any number of decks (and jokers can also be optional).

Table I below illustrates one exemplary set of rules.

TABLE I

| | |
|---|---|
| 1) | Play begins with each player making his wager(s). Players may wager on any of the hands with the following exceptions:<br>a) Player may only bet on the 3-card hand if he has wagered on all three of the 2-card hands.<br>b) The 3-card hand wager must be less than or equal to the lowest of the 2-card hand wagers. |
| 2) | After all wagers have been placed, the dealer will deal 2-3 cards per player, depending on the number of wagers placed. If a player wagers on a single 2-card hand only, that player will only receive two cards. Otherwise, each player will receive three cards. |
| 3) | Players will now have the option to either keep all of their original cards or discard one card and replace it with a new one from the shoe. |
| 4) | After each player has made his decision, the dealer will deal replacement cards to all players who have elected to make a switch, placing the new cards in the appropriate locations. The dealer will then assess which hands are winning hands and pay those hands according to the odds listed on the pay table. All other wagers from non-winning hands are lost and will be collected. |

It is noted that any of the rules in Table I can alternatively be optional. For example, rule 1 can be optional in that the player may be allowed to bet on the three card hand if he or she has not wagered on all of the two card hands. The 3-card hand wager may also be greater than the lowest of the 2-card hand wagers. In an embodiment, a player may be free to wager any amounts on any of the individual bets he or she wishes with no restriction. Alternatively, the player may be required to bet on two or all three two card hands, and may be required (or not) to bet on the three card hand. Regarding rule 2, optionally the player may be dealt three cards even if the player has not wagered on all individual two card hands.

Table II below illustrates possible winning two and three card hands and examples thereof.

TABLE II

| HAND | EXAMPLE | |
|---|---|---|
| | TWO CARDS | |
| Suited Blackjack | Ks As | Ac Qc |
| Suited Pair | 3h 3h | 8c 8c |
| Blackjack | Ks Ad | |
| Pair | Js Jh | |
| | THREE CARDS | |
| Straight Flush | Ac 2c 3c | 6d 7d 8d |
| Three of a Kind | 4h 4h 4h | 7s 7d 7c |
| Straight | 6h 7s 8d | Qs Ks Ad |
| Flush | 3d 6d 9d | |
| 3-card 21 | Ac Kc Kh | 2s 9c Jh |

Table III below illustrates a paytable for a two card hand and for a three card hand, their respective probabilities of occurring, and respective expected values. The probabilities are assuming optimal strategy, which would be determined by taking all ways to play each situation, cycle through all possible replacement cards, and the optimal way to play is the one with the highest average return. The expected value of a 2-card wager is −34.5020%. The expected value of the 3-card wager is 82.5208%. The expected value of three 2-card wagers and one 3-card wager combined is (−34.0520%×3+82.5208%)/4=−5.2463%. The negative of this value is the house's advantage: 5.2463%. Table III is based on four equal sized wagers on all four hands.

TABLE III

| HAND | PAY | PROBABILITY | EV % |
|---|---|---|---|
| | 2-CARD HAND | | |
| Suited Blackjack | 5 | 2.0076% | 10.0378% |
| Suited Pair | 4 | 2.2613% | 9.0451% |
| Blackjack | 3 | 6.0200% | 18.0599% |
| Pair | 1 | 9.0332% | 9.0332% |
| Other | −1 | 80.6780% | −80.6780% |
| Total | | 100% | −34.5020% |
| | 3-CARD HAND | | |
| Straight Flush | 30 | 0.5315% | 15.9458% |
| Three of a Kind | 25 | 1.7431% | 43.5787% |
| Straight | 5 | 6.7078% | 33.5389% |
| Flush | 3 | 13.7340% | 41.2020% |
| 3-card 21 | 1 | 12.7695% | 12.7695% |
| Other | −1 | 64.5141% | −64.5141% |
| Total | | 100% | 82.5208% |

FIG. 1 illustrates an exemplary betting layout, according to an embodiment. Top card 100, left card 102, and right card 104 can all be dealt by a dealer to a player. A left betting circle 106, a right betting circle 108, and a bottom betting circle 110 are adapted to receive wagers (can be in the form of chips or other monetary tokens) from the player. The left betting circle 106, the right betting circle 108, and the bottom betting circle 110 are all of two card wagers. The left betting circle 106 is for a wager based on a left two card hand formed with top card 100 and left card 102. The right betting circle 108 is for a wager based on a right two card hand formed with top card 100 and right card 104. The bottom betting circle 110 is for a wager based on a bottom two card hand formed with left card 102 and right card 104.

A center betting circle 112 is for a wager based on a three card hand formed with the top card 100, the left card 102, and the right card 104. A top betting circle 114 is for a wager involving a replacement card (to be discussed below in more detail). Also not pictured is a betting circle which can be for a progressive jackpot (also to be discussed below in more detail).

Figure 2:
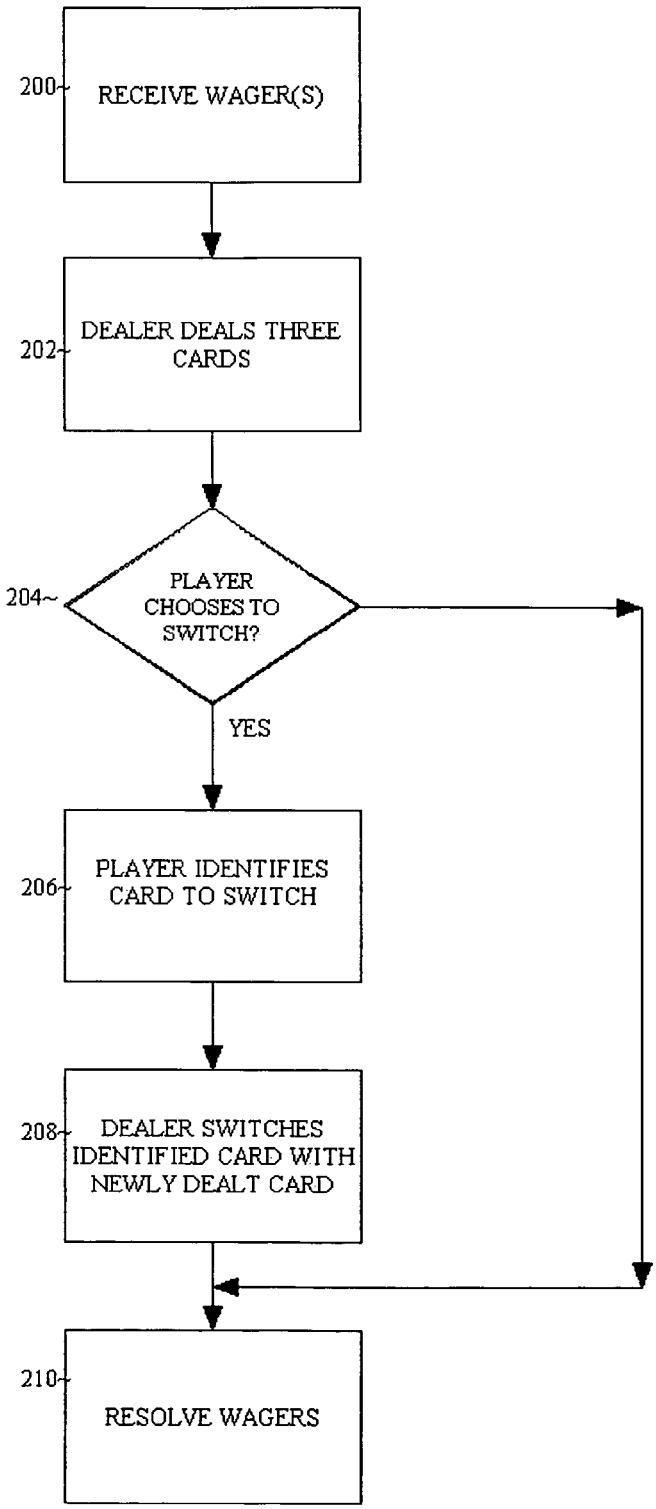
FIG. 2 illustrates an exemplary flowchart illustrating a method of playing a game, according to an embodiment.

FIG. 2 illustrates an exemplary flowchart illustrating a method of playing a game, according to an embodiment.

The method can start with operation 200, which receives wager(s) from the player. All four wagers can be required (three two card hand wagers and one three card hand wagers), at least one wager can be required (any one), or any combination of these wagers can either be required by the house or wagered at the player's option.

An optional wager can be placed on top betting circle 114 which is based on the selected card to replace (see operation 206). The player can make an even money switch bet on red or black, and if the player's replacement card is the suit bet on, the player wins even money (otherwise the player loses the switch bet). If the player chooses not to switch a card then the switch bet can push.

An additional wager can be a progressive jackpot. A player can place $1 (or any amount) in an additional progressive betting area in order to be eligible for a progressive jackpot. If the player's initial three cards (or alternatively his or her final three cards or alternatively either the initial or the final cards) comprise a predetermined jackpot payout (e.g. suited A K Q or any other unlikely combination) then the player wins a large progressive jackpot. Alternatively, the jackpot does not have to be progressive but just a large static payout.

After the wagers are placed in operation 200, the method can proceed to operation 202, wherein the dealer deals three (or any other number depending on the embodiment) cards to each player. The cards can be dealt in any order using the layout as illustrated in FIG. 1.

From operation 202, the method can proceed to operation 204, wherein the player can choose to replace one of the three cards dealt. The player may also opt not to replace any of the cards and keep the hand that the player has, wherein the method can proceed to operation 210.

If in operation 204, then the method can proceed to operation 206, wherein the player identifies which card to switch. He can do this for example, by point to the desired card to switch.

From operation 206, the method can proceed to operation 208, wherein the dealer switches (replaces) the identified card from operation 206 with a newly dealt card.

From operation 208, the method can proceed to operation 210, wherein the dealer resolves all wagers placed. The A left two card hand formed with top card 100 and left card 102 is determined and the wager in the left betting circle 106 is either paid or taken depending on the left two card hand and a respective paytable. A right two card hand is formed with the top card 100 and right card 104 is determined and the wager in the right betting circle 108 is either paid or taken depending on the right two card hand and a respective paytable. A bottom two card hand formed with the left card 102 and the right card 104 is determined and the wager in the bottom betting circle 110 is either paid or taken depending on the bottom two card hand and a respective paytable. A three card hand formed by the top card, the left card, and the right card, is also determined and the wager in the center betting circle 112 is either paid or taken depending on the three card hand.

The switch bet can be resolved at this point as well. If the player picked a particular color and the replacement card was that color, then the player wins the switch bet, otherwise the player loses. The switch bet can be mandatory or optional (e.g. the player can choose a replacement card without making the switch bet). There is no house advantage on the switch bet, or alternatively a house advantage can be worked into the switch bet.

Thus, as can be seen by the described and illustrated method, four wagers can be simultaneously placed and resolved on three cards.

It is noted that the operations illustrated and described with regard to FIG. 2 can be performed in any sensible order.

An example initial hand and all of the possible ways to play it will now be illustrated. This example assumes the payouts in Table III are used (although other winning combinations/payouts can be used) and also assumes the player wagers $1 on each of the four wagers (three two card hands and the three card hand, but does not wager on the switch bet or any progressive) for a total of $4 wagered.

Figure 3A:
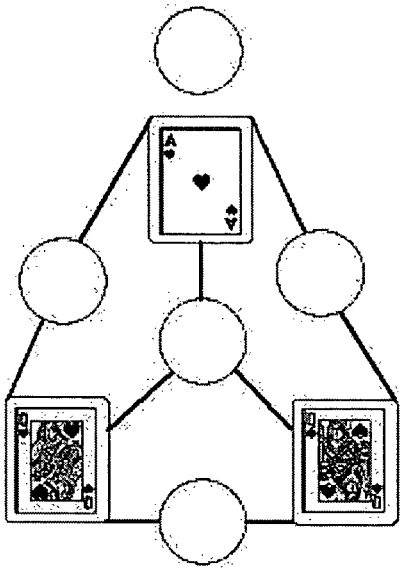
FIG. 3A illustrates an exemplary initial hand.

FIG. 3A illustrates an exemplary initial hand. The top card is ace of hearts (Ah), the left card is queen of hearts (Qh), and the right card is four of diamonds (Qs). The player can opt to keep all three cards, in which the left hand (Ah and Qh) is blackjack and is a winner (according to Table III pays 3:1 or $3), the right hand (Ah Qs) is blackjack and is a winner (according to Table III pays $3), the bottom hand (Qh Qs) is two pair and is a winner (according to Table III pays $1), but the three card hand (Ah Qh Qs) are losers. Thus, if the player does not switch a card, the player is paid $7.

Figure 3B:
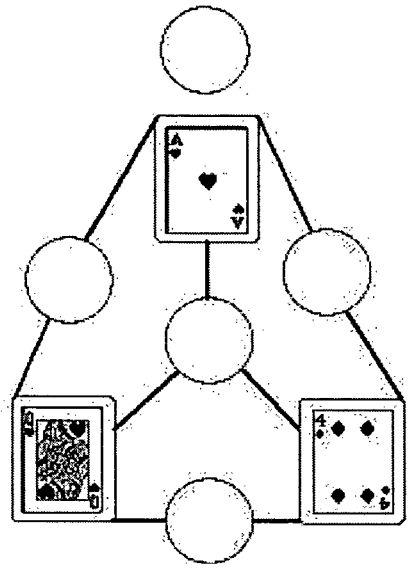
FIGS. 3B, 3C, and 3D illustrate outcomes of different ways to play the initial hand of 3A.
Figure 3C:
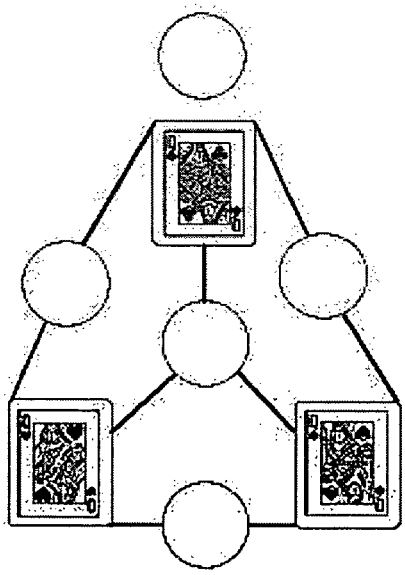
Figure 3D:
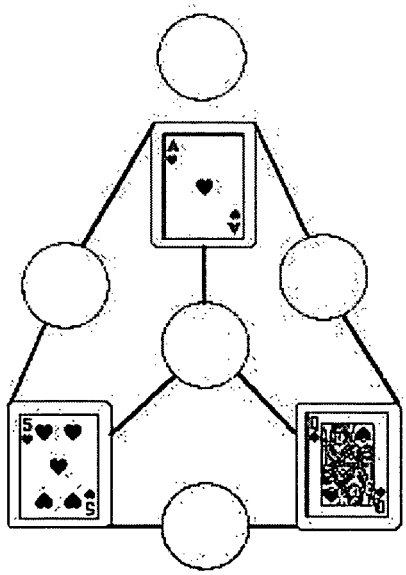

FIGS. 3B, 3C, and 3D illustrate outcomes of different ways to play the initial hand of 3A.

If the player is dealt the initial cards from FIG. 3A and decides to switch the right card, see FIG. 3B for the outcome assuming the next card dealt is a four of diamonds (4d). By switching the right card (without of course knowing the next card), the player is trying to achieve a straight flush for the three card hand. Now, the player has a winning left hand of (Ah Qh) which pays $3, a losing right hand of (Ah 4d), a losing bottom hand of (Qh 4d), and a losing three card hand of (Ah Qh 4d). The player is paid $3 in this case, having originally wagered $4, the player has lost $1 on the entire round of wagers.

If the player is dealt the initial cards from FIG. 3A and decides to switch the top card, see FIG. 3C for the outcome assuming the next card dealt is a queen of clubs (Qc). In this case, the player was trying to get a three of a kind for the three card hand. Now the player has a winning left hand which is a blackjack of (Qc Qh) which pays $3, a winning right hand of (Qc Qs) which is a pair paying $1, a winning bottom hand of (Qh Qs) which is a pair paying $1, and a winning three card hand of (Qc Qh Qs) which is three of a kind which pays $25 (see the three card hand paytable). Thus the player is paid a total of $27, having originally wagered $4, has won a net of $23, If the player is dealt the initial cards from FIG. 3A and decides to switch the left card, see FIG. 3D for the outcome assuming the next card dealt is a five of hearts (5h). This was an erroneous play, as the player has forfeited his or her chance of making either the straight flush of three of a kind. By switching the left card, the player has also forfeited the winning 21 hand on the left two card hand. Since the player was dealt a 5h on the left card, the player now has all losing hands: a losing left hand of (Ah 5h), a losing right hand of (Ah Qs), a losing bottom hand of (5h Qs), and a losing three card hand of (Ah, Qs, 5h). Here the player has lost all of his initial four $1 wagers which total $4.

Figure 4:
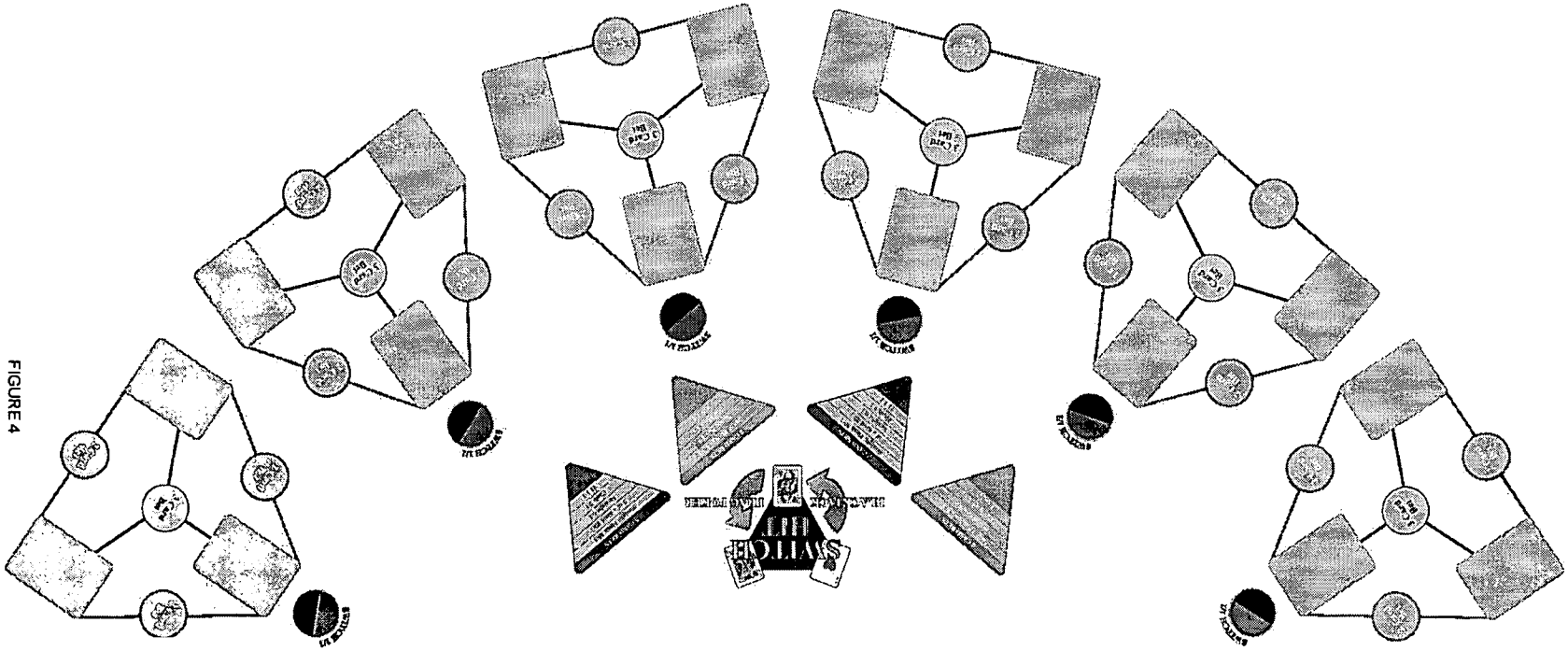
FIG. 4 illustrates an exemplary table layout, according to an embodiment.

FIG. 4 illustrates an exemplary table layout, according to an embodiment.

This layout allows for six simultaneous players, although of course any other amount of players can be accommodated for as well. The two card and three card paytables are displayed for the players' convenience.

The embodiments described herein can also be played in electronic form, on an electronic gaming device (EGD) or over the Internet. Programming to play the game can be stored on an electronic medium (e.g. CD-ROM, etc.)

Figure 5:
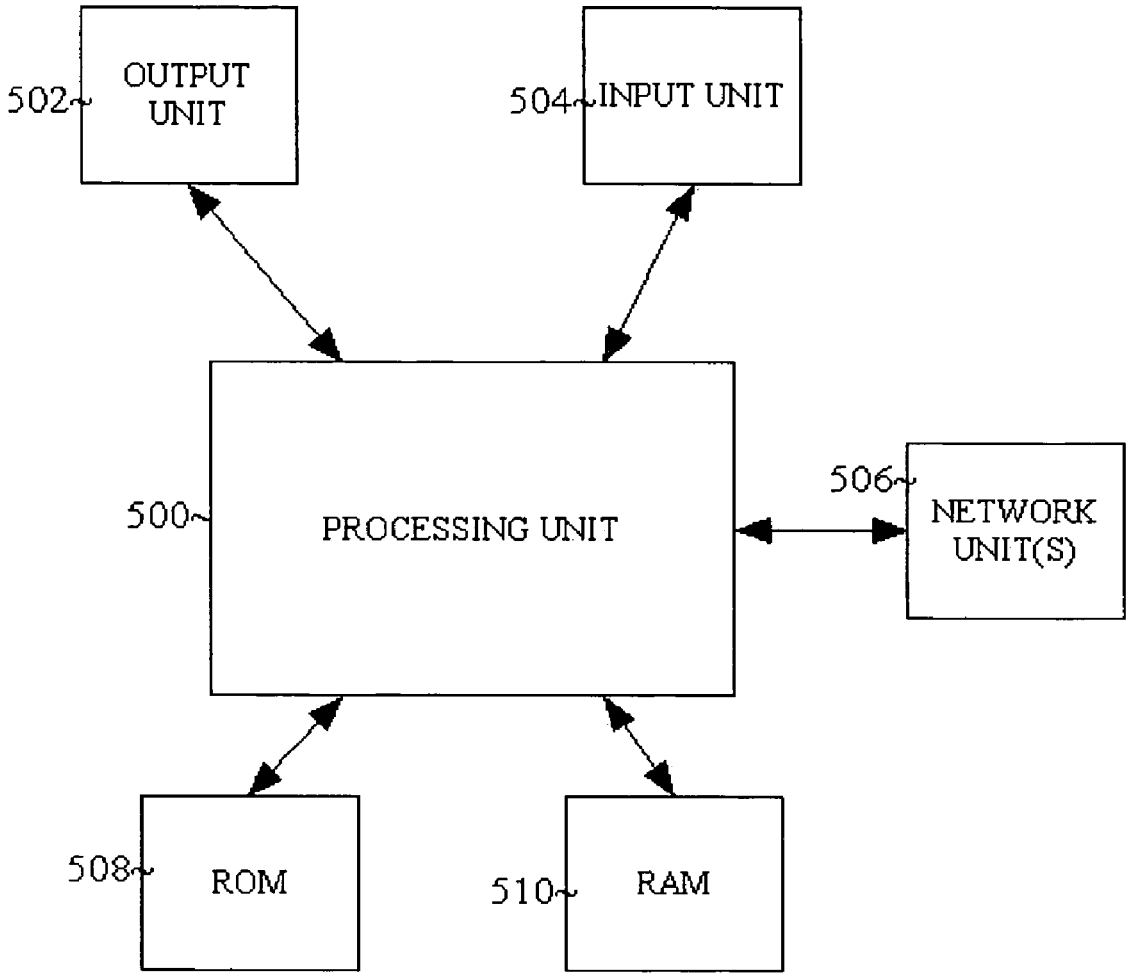
FIG. 5 illustrates an exemplary block diagram of an electronic format, according to an embodiment.

FIG. 5 illustrates an exemplary block diagram of an electronic format, according to an embodiment.

A processing unit 500 can be connected to known components such as an output unit 502 (e.g. CRT.) The processing unit 500 can also be connected to an input unit 504 (e.g. touch screen, keyboard, etc.) The processing unit 500 can also be connected to a network unit(s) 506 (e.g. comp card system, software server, Internet, etc.) The processing unit 500 can also be connected to a ROM 508 and a RAM 510, and any other known components needed to operate electronic versions of wagering games.

Thus, embodiments of the game described herein can combine elements of the popular games of blackjack and brag. Further, the game can generate from 1-5 bets (6 if you include a progressive) on a single round, thereby increasing the casino's action and profitability. Players should also enjoy the increased amount of action as multiple bets provide more excitement than a single bet game like blackjack.

Further, the game can also be played in a non-wagering form. For example, mock wagers can be placed for fun, or the game is just dealt without any aspect of wagering at all.

Further, embodiments described herein are not limited to the layouts as described and pictured. For example, the game can be played with four, five, or any number of cards. For example a four card layout can have six (or less) two card hands and four (or less) three card hands. A five card layout can be used as well with 10 (or less) two card hands and 10 (or less) three card hands.

In a further embodiment, more than one switch can be allowed. For example, the player can pick two cards out of the three (or however many cards are used) to switch. The player can pick two cards to switch simultaneously, or he or she can pick one, have the card replaced, and using the new card value, pick a second card to switch.

Tables IV through X represent alternative paytables, with equal sized bets for all four wagers, for use with the rules as illustrated in Table I. As stated above, in other embodiments, equal sized bets are not required.

TABLE IV

| HAND | PAY | PROBABILITY | EV % |
|---|---|---|---|
| | 2-CARD HAND | | |
| Suited Blackjack | 5 | 2.0105% | 10.0524% |
| Suited Pair | 5 | 2.2655% | 11.3274% |

TABLE IV-continued

| HAND | PAY | PROBABILITY | EV % |
|---|---|---|---|
| Blackjack | 3 | 6.0288% | 18.0863% |
| Pair | 1 | 9.0501% | 9.0501% |
| Other | −1 | 80.6451% | −80.6451% |
| Total | | | −32.1289% |
| 3-CARD HAND | | | |
| Straight Flush | 40 | 0.5504% | 22.0180% |
| Three of a Kind | 25 | 1.7431% | 43.5787% |
| Straight | 5 | 6.7564% | 33.7822% |
| Flush | 3 | 13.4110% | 40.2329% |
| 3-card 21 | 1 | 12.7776% | 12.7776% |
| Other | −1 | 64.7614% | −64.7614% |
| Total | | | 87.6279% |

House Edge: 2.1897%

TABLE V

| HAND | PAY | PROBABILITY | EV % |
|---|---|---|---|
| 2-CARD HAND | | | |
| Suited Blackjack | 5 | 2.0037% | 10.0186% |
| Suited Pair | 4 | 2.2736% | 9.0944% |
| Blackjack | 3 | 6.0085% | 18.0254% |
| Pair | 1 | 9.0826% | 9.0826% |
| Other | −1 | 80.6316% | −80.6316% |
| Total | | | −34.4106% |
| 3-CARD HAND | | | |
| Straight Flush | 35 | 0.5484% | 19.1948% |
| Three of a Kind | 25 | 1.7431% | 43.5787% |
| Straight | 6 | 7.2086% | 43.2513% |
| Flush | 3 | 13.0645% | 39.1936% |
| 3-card 21 | 1 | 12.0796% | 12.0796% |
| Other | −1 | 65.3557% | −65.3557% |
| Total | | | 91.9423% |

House Edge: 2.8224%

TABLE VI

| HAND | PAY | PROBABILITY | EV % |
|---|---|---|---|
| 2-CARD HAND | | | |
| Suited Blackjack | 5 | 2.0076% | 10.0378% |
| Suited Pair | 5 | 2.2613% | 11.3063% |
| Blackjack | 3 | 6.0200% | 18.0599% |
| Pair | 1 | 9.0332% | 9.0332% |
| Other | −1 | 80.6780% | −80.6780% |
| Total | | | −32.2407% |
| 3-CARD HAND | | | |
| Straight Flush | 30 | 0.5315% | 15.9458% |
| Three of a Kind | 25 | 1.7431% | 43.5787% |
| Straight | 5 | 6.7078% | 33.5389% |
| Flush | 3 | 13.7340% | 41.2020% |
| 3-card 21 | 1 | 12.7695% | 12.7695% |
| Other | −1 | 64.5141% | −64.5141% |
| Total | | | 82.5208% |

House Edge: 3.5503%

TABLE VII

| HAND | PAY | PROBABILITY | EV % |
|---|---|---|---|
| 2-CARD HAND | | | |
| Suited Blackjack | 5 | 2.0052% | 10.0260% |
| Suited Pair | 4 | 2.2753% | 9.1012% |
| Blackjack | 3 | 6.0102% | 18.0305% |
| Pair | 1 | 9.0562% | 9.0562% |
| Other | −1 | 80.6531% | −80.6531% |
| Total | | | −34.4393% |
| 3-CARD HAND | | | |
| Straight Flush | 25 | 0.5281% | 13.2037% |
| Three of a Kind | 20 | 1.7077% | 34.1534% |
| Straight | 5 | 6.5152% | 32.5759% |
| Flush | 4 | 14.7909% | 59.1635% |
| 3-card 21 | 1 | 11.2560% | 11.2560% |
| Other | −1 | 65.2021% | −65.2021% |
| Total | | | 85.1503% |

House Edge: 4.5412%

TABLE VIII

| HAND | PAY | PROBABILITY | EV % |
|---|---|---|---|
| 2-CARD HAND | | | |
| Suited Blackjack | 5 | 2.0076% | 10.0378% |
| Suited Pair | 4 | 2.2572% | 9.0288% |
| Blackjack | 3 | 6.0200% | 18.0599% |
| Pair | 1 | 9.0184% | 9.0184% |
| Other | −1 | 80.6969% | −80.6969% |
| Total | | | −34.5520% |
| 3-CARD HAND | | | |
| Straight Flush | 25 | 0.5315% | 13.2882% |
| Three of a Kind | 20 | 1.7148% | 34.2953% |
| Straight | 5 | 6.7078% | 33.5389% |
| Flush | 3 | 13.7340% | 41.2020% |
| 3-card 21 | 1 | 13.1547% | 13.1547% |
| Other | −1 | 64.1572% | −64.1572% |
| Total | | | 71.3218% |

House Edge: 8.0835%

TABLE IX

| HAND | PAY | PROBABILITY | EV % |
|---|---|---|---|
| 2-CARD HAND | | | |
| Suited Blackjack | 4 | 2.0062% | 8.0248% |
| Suited Pair | 4 | 2.2572% | 9.0288% |
| Blackjack | 3 | 6.0159% | 18.0478% |
| Pair | 1 | 9.0184% | 9.0184% |
| Other | −1 | 80.7023% | −80.7023% |
| Total | | | −36.5825% |
| 3-CARD HAND | | | |
| Straight Flush | 25 | 0.5315% | 13.2882% |
| Three of a Kind | 20 | 1.7148% | 34.2953% |
| Straight | 5 | 6.7159% | 33.5795% |
| Flush | 3 | 13.7340% | 41.2020% |
| 3-card 21 | 1 | 13.1669% | 13.1669% |
| Other | −1 | 64.1370% | −64.1370% |
| Total | | | 71.3948% |

House Edge: 9.5882%

TABLE X

| HAND | PAY | PROBABILITY | EV % |
|---|---|---|---|
| | 2-CARD HAND | | |
| Suited Blackjack | 4 | 2.0116% | 8.0465% |
| Suited Pair | 4 | 2.2572% | 9.0288% |
| Blackjack | 3 | 6.0321% | 18.0964% |
| Pair | 1 | 8.9839% | 8.9839% |
| Other | −1 | 80.7151% | −80.7151% |
| Total | | | −36.5595% |
| | 3-CARD HAND | | |
| Straight Flush | 30 | 0.5336% | 16.0066% |
| Three of a Kind | 15 | 1.7077% | 25.6150% |
| Straight | 4 | 6.6449% | 26.5797% |
| Flush | 3 | 13.8397% | 41.5190% |
| 3-card 21 | 1 | 13.1663% | 13.1663% |
| Other | −1 | 64.1078% | −64.1078% |
| Total | | | 58.7789% |

House Edge: 12.7249%

It is also noted that any and/or all of the above embodiments, configurations, variations of the present invention described above can mixed and matched and used in any combination with one another.

Moreover, any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game, the method comprising:

receiving from a player a first wager, a second wager, a third wager, and a fourth wager;

dealing only three initial cards to the player comprising a first card, a second card, and a third card to the player;

allowing the player to choose at most only one chosen card comprising either none or only one of the first card, the second card, or the third card;

replacing the chosen card with a new card, wherein if the chosen card is the first card then the first card is now the new card, if the chosen card is the second card then the second card is now the new card, if the chosen card is the third card then the third card is now the new card;

paying the first wager using a two card paytable and a first two card hand formed between the first card and the second card, the first hand being formed after the replacing;

paying the second wager using the two card paytable and a second two card hand formed between the second card and the third card, the second hand being formed after the replacing;

paying the third wager using the two card paytable and a third two card hand formed between the first card and the third card, the third hand being formed after the replacing; and paying the fourth wager using a three card paytable and a three card hand formed between the first card, the second card, and third card, the three card hand being formed after the replacing, wherein the first wager, second the third wager, the third wager, and the fourth wager, are all resolved without regard to a dealer's hand.

2. A method as recited in claim 1, wherein the two card paytable comprises a suited blackjack which has a highest payout.

3. A method as recited in claim 1, wherein the two card paytable comprises a blackjack.

4. A method as recited in claim 1, wherein the three card paytable comprises a straight flush.

5. A method as recited in claim 1, wherein the three card paytable comprises a three card 21.

6. An electronic gaming apparatus to play a wagering game, the apparatus comprising:

a processor, performing:

receiving from a player a first wager, a second wager, a third wager, and a fourth wager;

dealing only three initial cards to the player comprising a first card, a second card, and a third card to the player;

allowing the player to choose at most only one chosen card comprising either none or only one of the first card, the second card, or the third card;

replacing the chosen card with a new card, wherein if the chosen card is the first card then the first card is now the new card, if the chosen card is the second card then the second card is now the new card, if the chosen card is the third card then the third card is now the new card;

paying the first wager using a two card paytable and a first two card hand formed between the first card and the second card, the first hand being formed after the replacing;

paying the second wager using the two card paytable and a second two card hand formed between the second card and the third card, the second hand being formed after the replacing;

paying the third wager using the two card paytable and a third two card hand formed between the first card and the third card, the third hand being formed after the replacing;

paying the fourth wager using a three card paytable and a three card hand formed between the first card, the second card, and the third card, the three card hand being formed after the replacing; and an output device to output results of the processor, wherein the first wager, the second wager, the third wager, and the fourth wager, are all resolved without regard to a dealer's hand.

* * * * *